US011440332B2

(12) United States Patent
Sato et al.

(10) Patent No.: US 11,440,332 B2
(45) Date of Patent: Sep. 13, 2022

(54) RECORDING HEAD UNIT, RECORDING DEVICE, AND RECORDING METHOD

(71) Applicant: SEIKO EPSON CORPORATION, Tokyo (JP)

(72) Inventors: Hiroki Sato, Nagano (JP); Masaaki Hagio, Nagano (JP); Keigo Yamasaki, Nagano (JP); Tomoyuki Nakano, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 65 days.

(21) Appl. No.: 17/159,261

(22) Filed: Jan. 27, 2021

(65) Prior Publication Data

US 2021/0229457 A1 Jul. 29, 2021

(30) Foreign Application Priority Data

Jan. 29, 2020 (JP) ..... JP2020-012247

(51) Int. Cl.
*B41J 2/21* (2006.01)
*B41J 11/00* (2006.01)
*B41J 2/155* (2006.01)

(52) U.S. Cl.
CPC ..... *B41J 2/2132* (2013.01); *B41J 2/155* (2013.01); *B41J 11/005* (2013.01)

(58) Field of Classification Search
CPC ..... B41J 13/10; B41J 29/12; B41J 2202/21; B41J 11/0035; B41J 11/0005; B41J 2/2146; B41J 3/54; B41J 11/006; B41J 11/0045; B41J 2/16585; B41J 2/14; B41J 2/1433; B41J 2002/14443; B41J 2/155
See application file for complete search history.

(56) References Cited

U.S. PATENT DOCUMENTS

2013/0044160 A1* 2/2013 Ronk ..... B41J 29/12 347/37
2014/0176639 A1* 6/2014 Tunmore ..... B41J 2/155 347/25

FOREIGN PATENT DOCUMENTS

| | | | | |
|---|---|---|---|---|
| JP | 2005205785 A | * | 8/2005 | |
| JP | 2007203465 A | * | 8/2007 | |
| JP | 2009-096057 A | | 5/2009 | |
| JP | 2009292023 A | * | 12/2009 | |
| JP | 2010162873 A | * | 7/2010 | ..... B41J 2/1433 |
| JP | 2010-214848 A | | 9/2010 | |
| JP | 2010-228215 A | | 10/2010 | |
| JP | 2010-228216 A | | 10/2010 | |
| JP | 2010221524 A | * | 10/2010 | |
| JP | 6468902 B2 | * | 2/2019 | |
| JP | 2019-123129 A | | 7/2019 | |

* cited by examiner

*Primary Examiner* — Julian D Huffman

(74) *Attorney, Agent, or Firm* — Global IP Counselors, LLP

(57) ABSTRACT

A recording head unit includes a first line head and a second line head in which nozzles are provided in an X-axis direction. The first line head is arranged on one side of the second line head in a Y-axis direction intersecting the X-axis direction. The first line head includes a first windbreak member. The second line head includes a second windbreak member. A length by which the first windbreak member protrudes is smaller than a length by which the second windbreak member protrudes.

11 Claims, 8 Drawing Sheets

RECORDING HEAD UNIT, RECORDING DEVICE, AND RECORDING METHOD

The present application is based on, and claims priority from JP Application Serial Number 2020-012247, filed Jan. 29, 2020, the disclosure of which is hereby incorporated by reference herein in its entirety.

BACKGROUND

1. Technical Field

The present disclosure relates to a recording head unit that ejects ink droplets, a recording device that perform recording by causing ink droplets to be ejected onto a recording medium, and a recording method using the recording device.

2. Related Art

JP-A-2009-96057 describes an ink-jet printer including a windbreak wall that is arranged in a periphery of a recording head for ejecting ink onto a recording medium and is capable of moving vertically with respect to an ink ejection unit of the recording head. According to the ink-jet printer, a flying curve of ink, which is caused by an airflow generated during recording, can be prevented.

However, in the ink-jet printer described in JP-A-2009-96057, the windbreak wall is always under a state of being oriented downward in a direction toward the recording medium due to its own weight or a biasing force of a spring. The recording medium is swollen to a large extent by the ink applied during recording, depending on a type of the recording medium. Thus, cockling of the recording medium is caused during recording, and the recording medium is caught by the windbreak wall, which may cause a problem of jamming.

SUMMARY

A recording head unit according to the present disclosure includes a first line head and a second line head in which a plurality of nozzles for ejecting liquid are provided in a nozzle row direction, wherein the first line head is arranged on one side of the second line head in a head row direction intersecting the nozzle row direction, the first line head includes a first windbreak member on the one side in the head row direction along a width of the first line head in the nozzle row direction, the first windbreak member protruding, in a liquid ejection direction in which the liquid is ejected, with respect to a nozzle opening surface at which the plurality of nozzles included in the first line head are open, the second line head includes a second windbreak member between the second line head and the first line head along a width of the second line head in the nozzle row direction, the second windbreak member protruding, in the liquid ejection direction in which the liquid is ejected, with respect to a nozzle opening surface at which the plurality of nozzles included in the second line head are open, and a length by which the second windbreak member protrudes is smaller than a length by which the first windbreak member protrudes.

A recording device according to the present disclosure includes a platen configured to support a recording medium, a first line head and a second line head facing the platen and in which a plurality of nozzles for ejecting liquid onto the recording medium supported by the platen are provided in a nozzle row direction, and a transport unit configured to transport the recording medium supported by the platen in a transport direction intersecting the nozzle row direction, wherein the first line head is arranged upstream of the second line head in the transport direction, the first line head includes a first windbreak member upstream thereof in the transport direction along a width of the first line head in the nozzle row direction, the first windbreak member protruding toward the platen with respect to a nozzle opening surface at which the plurality of nozzles included in the first line head are open, the second line head includes a second windbreak member between the second line head and the first line head along a width of the second line head in the nozzle row direction, the second windbreak member protruding toward the platen with respect to a nozzle opening surface at which the plurality of nozzles included in the second line head are opened, and a length by which the second windbreak member protrudes is smaller than a length by which the first windbreak member protrudes.

A recording method according to the present disclosure is a recording method using the recording device described above, and includes an accumulated liquid amount calculating step of calculating, based on the image data, an amount of accumulated liquid applied on the recording medium at each of positions where the line heads are arranged, and a controlling step of controlling the lengths by which the second windbreak member and the third windbreak member protrude, based on the amount of the accumulated liquid calculated for each of the positions where the line heads are arranged.

DESCRIPTION OF EXEMPLARY EMBODIMENTS

1. Exemplary Embodiment 1

Figure 1:
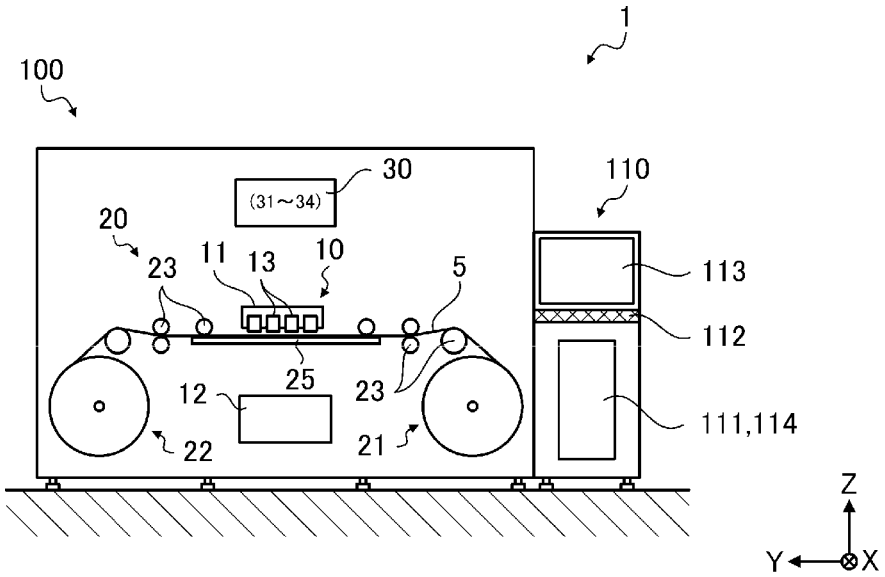
FIG. 1 is a front view illustrating a configuration example of a recording system as a recording device according to Exemplary Embodiment 1.
Figure 2:
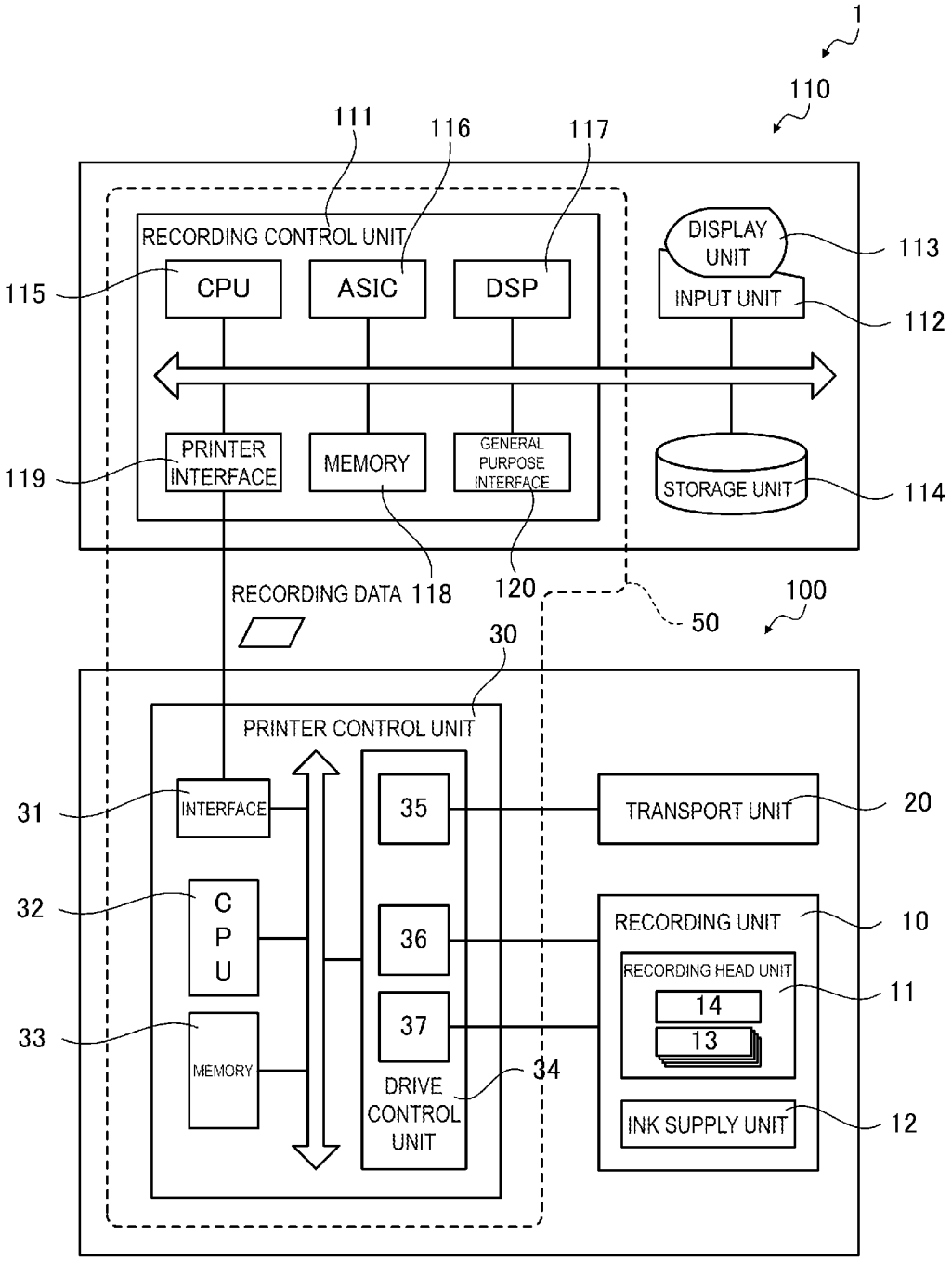
FIG. 2 is a block diagram illustrating a configuration example of the recording system as the recording device according to Exemplary Embodiment 1.

With reference to FIG. 1 and FIG. 2, a configuration of a recording system 1 as a recording device according to Exemplary Embodiment 1 is described.

Note that, as for coordinates given in the drawings, it is assumed that a Z-axis direction is an up/down direction, a +Z direction is an upward direction, an X-axis direction is a front/rear direction, a −X direction is a frontward direction, a Y-axis direction is a left/right direction, a +Y direction is a leftward direction, and an X-Y plane is a horizontal plane.

The recording system 1 includes a printer 100, and an image processing device 110 connected to the printer 100. The printer 100 is a line-head-type ink-jet printer that records a desired image on a recording medium 5 fed in a state of being wound into a roll, based on recording data received from the image processing device 110. As the recording medium 5, for example, wood-free paper, cast paper, art paper, coat paper, and synthetic paper may be used.

The image processing device 110 includes a recording control unit 111, an input unit 112, a display unit 113, a storage unit 114, and the like, and controls recording jobs for causing the printer 100 to perform recording. In a preferred example, the image processing device 110 is configured using a personal computer.

Software operated by the image processing device 110 includes general image processing application software for handling image data to be recorded, and printer driver software for controlling the printer 100 and for generating recording data that causes the printer 100 to perform recording. In the following description, the image processing application software is simply referred to as an image processing application. Further, the printer drive software is simply referred to as a printer driver.

Here, the image data refers to RGB digital image information including text data, full-color image data, and the like.

The recording control unit 111 includes a CPU 115, an ASIC 116, a DSP 117, a memory 118, a printer interface 119, a general purpose interface 120, and the like, and performs centralized control for the entire recording system 1.

Here, the CPU stands for Central Processing Unit, the ASIC stands for Application Specific Integrated Circuit, and the DSP stands for Digital Signal Processor. The input unit 112 is an information input means serving as a user interface. Specifically, the input unit 112 is, for example, a port or the like for connecting a keyboard, a mouse pointer, or an information input device.

The display unit 113 is an information display means serving as a user interface, and displays information input from the input unit 112, an image to be recorded by the printer 100, information about a recording job, and the like, based on the control of the recording control unit 111.

The storage unit 114 is a rewritable storage medium such as a hard disk drive or a memory card, and stores programs run by the recording control unit 111 as software run by the image processing device 110, an image to be recorded, information about a recording job, and the like.

The memory 118 is a storage medium that secures a region for storing programs run by the CPU 115, a work region in which such programs run, and the like, and includes storage elements such as a RAM and an EEPROM. Here, the RAM stands for Random Access Memory, and the EEPROM stands for Electrically Erasable Programmable Read-Only Memory. The general purpose interface 120 is an interface capable of connecting external electronic devices, such as a LAN interface, a USB interface, and the like.

The LAN stands for Local Area Network, and the USB stands for Universal Serial Bus.

The printer 100 includes a recording unit 10, a transport unit 20, and a printer control unit 30. When the printer 100 receives recording data from the image processing device 110, the printer 100 controls the recording unit 10 and the transport unit 20 by the printer control unit 30, and records an image on the recording medium 5, based on the recording data.

The recording data is image formation data obtained by converting the image data so that the printer 100 can perform recording using the image processing application and the printer driver included in the image processing device 110, and includes a command for controlling the printer 100.

The recording unit 10 includes a recording head unit 11, an ink supply unit 12, and the like. The transport unit 20 includes a supply unit 21, a storage unit 22, transport rollers 23, a platen 25, and the like.

The head unit 11 includes four line heads 13 and a head control unit 14. Each of the line heads 13 includes nozzle rows in which a plurality of nozzles for ejecting ink in a form of ink droplets are provided. The ink serves as liquid for recording. Each of the line heads 13 ejects ink droplets onto the recording medium 5 supported by the platen 25, based on the control of the printer control unit 30. With this, a plurality of dot rows corresponding to the nozzle rows are formed on the recording medium 5. The transport unit 20 causes the recording medium 5 to move relative to the recording head unit 11, and thus the dots rows are formed. With this, a desired image based on the image data is recorded.

Note that, in the present exemplary embodiment, the recording control unit 111 and the printer control unit 30 constitutes a control unit 50 that controls the recording unit 10 and the transport unit 20 and performs recording, based on the image data.

The ink supply unit 12 includes an ink tank, and an ink supply path through which ink is supplied from the ink tank to the line head 13. The ink supply path is omitted in illustration. An ink set of four colors obtained by adding black K to an ink set of three colors of cyan C, magenta M, and yellow Y is used as the ink. The four line heads 13 correspond the four colors of the ink, and the ink tank, the ink supply channel, and an ink supply path to nozzles that eject the same ink are provided separately for each of the colors of the ink.

As for a method of ejecting ink droplets, a piezo method is employed. The piezo method is a recording method, in which a pressure corresponding to a recording information signal is applied to the ink stored in a pressure generating chamber by an actuator including a piezo element as a piezoelectric element, and ink droplets are jetted from a nozzle communicating with the pressure generating chamber.

Note that the method of ejecting ink droplets is not limited thereto, and may be any other recording method of jetting ink in a form of droplets and forming a dot group on a recording medium.

The transport unit 20 moves the recording medium 5 relative to the recording head unit 11 under the control of the printer control unit 30.

The supply unit 21 rotatably supports a reel on which the recording medium 5 is wounded into a roll, and feeds the recording medium 5 into a transport path. The storage unit 22 rotatably supports the reel that rolls up the recording medium 5, and rolls up the recorded recording medium 5 from the transport path.

The transport rollers 23 include a driving roller that causes the recording medium 5 to move on an upper surface of the platen 25 in the Y-axis direction, a driven roller that rotates in accordance with the movement of the recording medium 5, and the like, and constitutes the transport path for transporting the recording medium 5 from the supply unit 21 to the storage unit 22 via a recording region of the recording unit 10. The recording region is a region in which the line head 13 ejects the ink on the upper surface of the platen 25 and causes the ink to land on the recording medium 5.

Note that, in the present exemplary embodiment, the relative moving direction in which the line head 13 and the recording medium 5 move relative to each other corresponds to the transport direction of the recording medium 5 in the recording region, and corresponds to the Y-axis direction.

The printer control unit 30 includes an interface 31, a CPU 32, a memory 33, and a drive control unit 34, and the like, and controls the recording unit 10 and the transport unit 20.

The interface 31 is connected to the printer interface 119 of the image processing device 110, and transmits and receives data between the image processing device 110 and the printer 100.

The CPU 32 is an arithmetic processing unit for overall control of the printer 100.

The memory 33 is a storage medium that secures a region for storing programs run by the CPU 32, a work region in which such programs run, and the like, and includes storage elements such as a RAM and an EEPROM.

The CPU 32 controls the recording unit 10 and the transport unit 20 through the drive control unit 34 in accordance with the program stored in the memory 33 and the recording data received from the image processing device 110.

The drive control unit 34 includes firmware operating based on the control of the CPU 32, and controls driving of the recording head unit 11 and ink supply unit 12 of the recording unit 10, and the transport unit 20. The drive control unit 34 includes drive control circuits including a motion control signal generation circuit 35, an ejection control signal generation circuit 36, and a drive signal generation circuit 37, and a ROM and a flash memory incorporating firmware controlling the drive control circuits. The ROM and the flash memory incorporating firmware controlling the drive control circuits are omitted in illustration. Here, the ROM stands for Read-Only Memory.

The motion control signal generation circuit 35 is a circuit that generates a signal for controlling the transport unit 20, in accordance with an instruction from the CPU 32 based on the printing data.

The ejection control signal generation circuit 36 is a circuit that generates a head control signal for selecting nozzles that eject ink, selecting an ejection amount, controlling an ejection timing, and the like, in accordance with an instruction from the CPU 32 based on the printing data.

The drive signal generation circuit 37 is a circuit that generates a drive waveform for driving a pressure generation unit provided in the line head 13 for the purpose of ejecting ink.

The head control unit 14 drives the line head 13 in accordance with signals from the ejection control signal generation circuit 36 and the drive signal generation circuit 37, based on the recording data.

Figure 3:
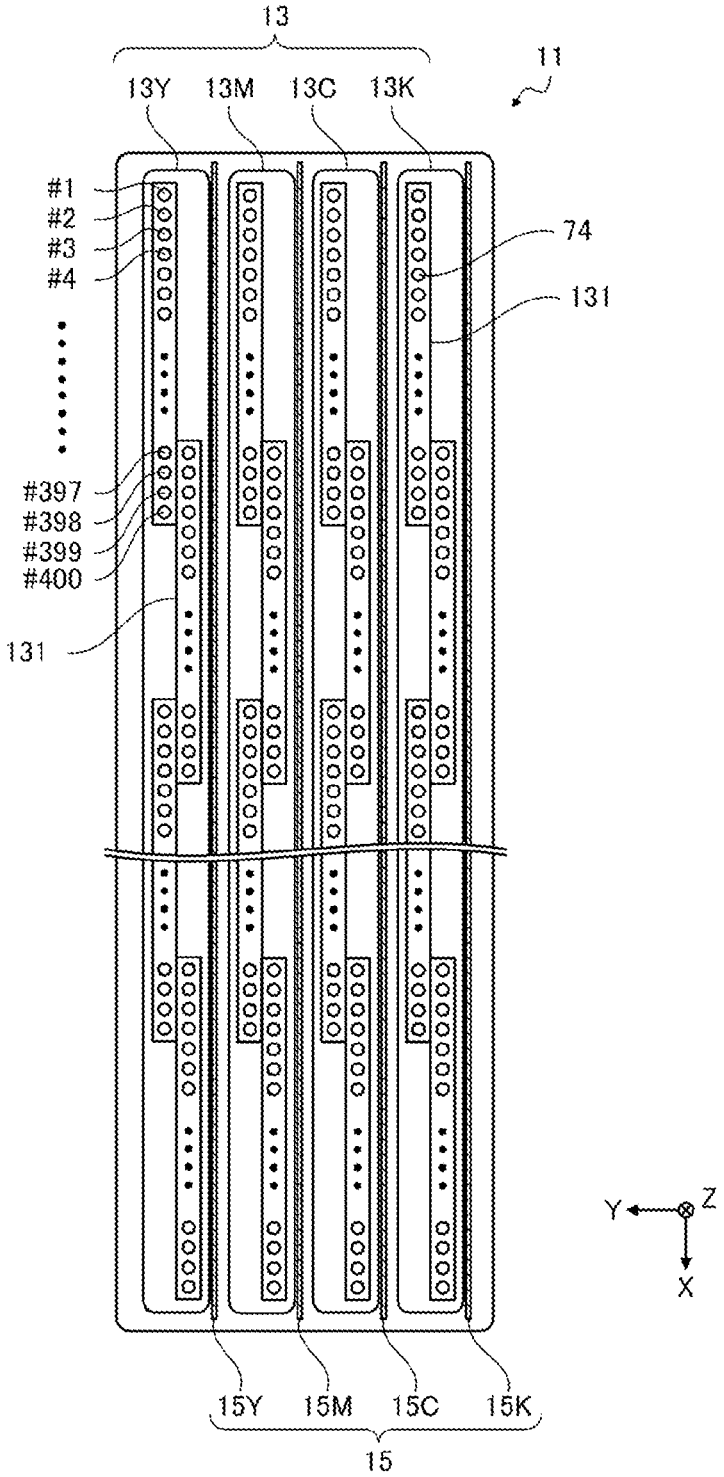
FIG. 3 is a schematic view illustrating a configuration example of a recording head unit according to Exemplary Embodiment 1, which is seen from a lower surface.
Figure 4:
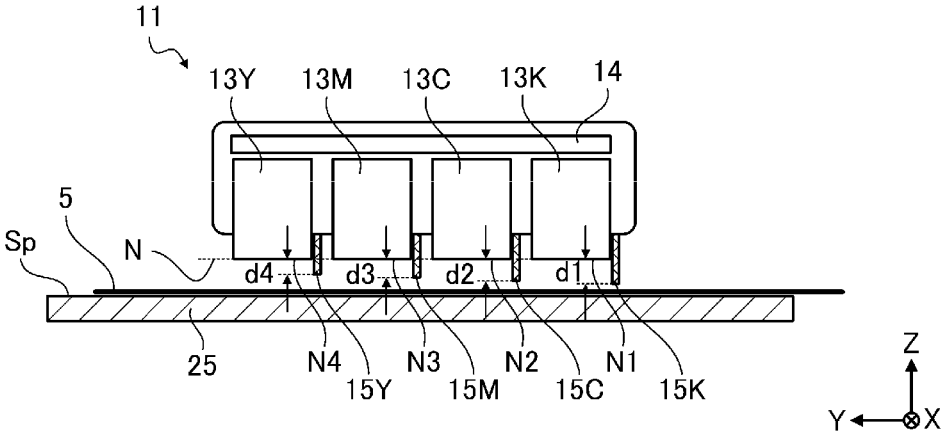
FIG. 4 is a schematic view illustrating a configuration example of the recording head unit according to Exemplary Embodiment 1, which is seen from a front surface.

Next, with reference to FIG. 3 and FIG. 4, a configuration example of the recording head unit 11 is described.

The recording head unit 11 includes the four line heads 13, the head control unit 14, and four windbreak members 15.

The four line heads 13 include the line head 13K that ejects the ink of black K, the line head 13C that ejects the ink of cyan C, the line head 13M that ejects the ink of magenta M, and the line head 13Y that ejects the ink of yellow Y, and are aligned in the stated order from upstream to downstream in the transport direction of the recording medium 5, that is, from the −Y side to the +Y side.

In the present exemplary embodiment, the line head 13K corresponds to a first line head, the line head 13C corresponds to a second line head, and the line head 13M corresponds to a third line head.

Specifically, the line head 13K serving as the first line head is arranged on the −Y side in the Y-axis direction as a head row direction intersecting a nozzle row direction, the −Y direction being one side of the line head 13C serving as the second line head. Further, the line head 13M serving as the third line head is arranged on the +Y side in the Y-axis direction as the head row direction, the +Y side being the other side of the line head 13C serving as the second line head. Further, the line head 13Y is arranged on the +Y side being the other side of the line head 13M in the Y-axis direction as the head row direction.

Each of the line heads 13 includes a plurality of head chips 131 arrayed along the X-axis direction intersecting the transport direction, that is, the Y-axis direction.

In each of the head chips 131, 400 nozzles 74 denoted with #1 to #400 for ejecting ink are provided in a line in the X-axis direction as the nozzle row direction. Further, as illustrated in FIG. 3, the head chips 131 are continuously arrayed in such a way that positions of four nozzles 74 on one end of the head chip 131 in the X-axis direction overlap positions of four nozzles 74 on the other end of the adjacent head chip 131 in the X-axis direction.

The four windbreak members 15 are members that prevent an airflow, which is generated in the recording region while transporting the recording medium 5, from affecting tracks of ink droplets ejected while performing recording, and are provided on the −Y sides of the four line heads 13, respectively, that is, upstream in the transport direction of the recording medium 5.

The four windbreak members 15 include a windbreak member 15K as a first windbreak member provided on the −Y side of the line head 13K, a windbreak member 15C as a second windbreak member provided on the −Y side of the line head 13C, a windbreak member 15M as a third windbreak member provided on the −Y side of the line head 13M, and a windbreak member 15Y provided on the −Y side of the line head 13Y.

Each of the windbreak members 15 is a rectangular plate member extending in the X-Z plane, and is provided to protrude along the nozzle row direction of each of the line heads 13, that is, the width in the X-axis direction, toward the platen 25, that is, the −Z direction being the ink ejection direction as a liquid ejection direction with respect to a nozzle opening surface N to which the plurality of nozzles 74 included in each of the line heads 13 are opened.

Specifically, the line head 13K includes the windbreak member 15K upstream in the transport direction, that is, on the −Y side along the width of the line head 13K in the nozzle row direction, which protrudes toward the platen 25, that is, the ink ejection direction with respect to a nozzle opening surface N1 to which the plurality of nozzles 74 included in the line head 13K are opened. The line head 13C includes the windbreak member 15C between the line head 13C and the first line head, that is, the line head 13K along the width of the line head 13C in the nozzle row direction, which protrudes toward the platen 25, that is, the ink ejection direction with respect to a nozzle opening surface N2 to which the plurality of nozzles 74 included in the line head 13C are opened. The line head 13M includes the windbreak member 15M between the line head 13M and the line head 13C along the width of the line head 13M in the nozzle row direction, which protrudes toward the platen 25, that is, the ink ejection direction with respect to a nozzle opening surface N3 to which the plurality of nozzles 74 included in the line head 13M are opened.

Further, the line head 13Y includes the windbreak member 15Y between the line head 13Y and the line head 13M along the width of the line head 13Y in the nozzle row direction, which protrudes toward the platen 25, that is, the ink ejection direction with respect to a nozzle opening surface N4 to which the plurality of nozzles 74 included in the line head 13Y are opened.

A length d2 by which the windbreak member 15C protrudes from a height of the nozzle opening surface N2 is smaller than a length d1 by which the windbreak member 15K protrudes from a height of the nozzle opening surface N1, and a length d3 by which the windbreak member 15M protrudes from a height of the nozzle opening surface N3 is equal to or smaller than the length d2 by which the windbreak member 15C protrudes from the height of the nozzle opening surface N2. Further, a length d4 by which the windbreak member 15Y protrudes from a height of the nozzle opening surface N4 is equal to or smaller than the length d3 by which the windbreak member 15M protrudes from the height of the nozzle opening surface N3.

Note that, in the present exemplary embodiment, the support surface Sp on which the platen 25 supports the recording medium 5 is in the horizontal plane, that is, the X-Y plane. The nozzle opening surface N1 to the nozzle opening surface N4 are included in the nozzle opening surface N flush with the support surface Sp of the platen 25.

Further, a distance that is necessary and sufficient for the recording medium 5 to pass therethrough is secured between the protruding distal end of the windbreak member 15K and the support surface Sp of the platen 25.

According to the present exemplary embodiment, the following effects can be obtained.

First, as an effect of the recording head unit 11, when the recording head unit 11 is mounted to the recording system 1 and is used, the recording head unit 11 is installed in such a way that the nozzle opening surface N faces the platen 25 of the recording system 1 and that the line head 13K is upstream of the transport direction in which the recording medium 5 is transported during recording. With this, an airflow, which is generated between the nozzle opening surface N of each of the line heads 13 and the recording medium 5 while transporting the recording medium 5, can be weakened by the windbreak member 15K, the windbreak member 15C, the windbreak member 15M, and the windbreak member 15Y.

Further, when the recording medium 5 is swollen by the ink applied during recording, a swelling degree tends to be larger as an amount of the applied ink is increased or as a time elapses for some time directly after the ink starts to be applied. Thus, as being transported toward downstream via the line head 13K, the recording medium 5 during recording tends to have a larger degree of cockling along with swelling and tends to rise upward from the platen 25. In contrast, the recording head unit 11 is installed in such a way that the line head 13K is upstream in the transport direction of the recording medium 5. With this, the length by which the windbreak member 15C downstream protrudes is smaller than the length by which the windbreak member 15K upstream protrudes. Thus, in the recording head unit 11, jamming, which is caused by the recording medium 5 caught by the distal end of the windbreak member 15C, is suppressed.

Further, the length of the windbreak member 15M downstream with respect to the windbreak member 15C protrudes, is equal to or smaller than the length by which the windbreak member 15C upstream protrudes. Thus, jamming, which is caused by the recording medium 5 caught by the distal end of the windbreak member 15M, is suppressed.

Further, the length by which the windbreak member 15Y downstream with respect to the windbreak member 15M protrudes, is equal to or smaller than the length of the windbreak member 15M upstream protrudes. Thus, jamming, which is caused by the recording medium 5 caught by the distal end of the windbreak member 15Y, is suppressed.

Next, as an effect of the recording system 1, the recording system 1 includes the recording head unit 11, and hence an airflow, which is generated between the nozzle opening surface N of each of the line heads 13 and the recording medium 5 while transporting the recording medium 5, can be weakened by the windbreak member 15K, the windbreak member 15C, the windbreak member 15M, and the windbreak member 15Y.

Further, as being transported toward downstream via the line head 13K, the recording medium 5 during recording tends to have a larger degree of cockling along with swelling and tends to rise upward from the platen 25. In view of this, the length by which the windbreak member 15C protrudes is smaller than the length by which the windbreak member 15K protrudes. Specifically, the length from the support surface Sp of the platen 25, which supports the recording medium 5, to the protruding distal end of the windbreak member 15C is larger than the length from the support surface Sp to the protruding distal end of the windbreak member 15K. Thus, jamming, which is caused by the recording medium 5 caught by the distal end of the windbreak member 15C, is suppressed.

Further, the length of the windbreak member 15M downstream with respect to the windbreak member 15C protrudes, is equal to or smaller than the length by which the windbreak member 15C upstream protrudes. Specifically, the length from the support surface Sp of the platen 25, which supports the recording medium 5, to the protruding distal end of the windbreak member 15M is equal to or larger than the length from the support surface Sp to the protruding distal end of the windbreak member 15C. Thus, jamming, which is caused by the recording medium 5 caught by the distal end of the windbreak member 15M, is suppressed.

Further, the length by which the windbreak member 15Y downstream with respect to the windbreak member 15M protrudes, is equal to or smaller than the length of the windbreak member 15M upstream protrudes. Specifically, the length from the support surface Sp of the platen 25, which supports the recording medium 5, to the protruding distal end of the windbreak member 15Y is equal to or larger than the length from the support surface Sp to the protruding distal end of the windbreak member 15M. Thus, jamming, which is caused by the recording medium 5 caught by the distal end of the windbreak member 15Y, is suppressed.

Note that, in the present exemplary embodiment, a case where the recording head unit 11 includes the four line heads 13 is described as an example, but the number of line heads 13 is not limited thereto.

For example, in a recording system 1M, which includes a monochrome printer 100M and performs recording by ejecting an ink set including black ink and post-processing liquid for improving wear resistance of the black ink, the recording head unit 11 may have a configuration including two line heads, which are a first line head for ejecting the black ink and a second line head for ejecting the post-processing liquid. The length by which the second windbreak member included in the second line head protrudes is smaller than the length by which the first windbreak member included in the first line head protrudes, and hence jamming, which is caused by the recording medium 5 caught by the distal end of the second windbreak member, is suppressed.

Further, for example, a case where the recording head unit 11 includes five or more line heads may be adopted. A length by which a windbreak member included in the third or following line head downstream protrudes, is equal to or smaller than a length by which a windbreak member on upstream thereof. With this, jamming, which is caused by the recording medium 5 caught by the distal end of the windbreak member downstream, is suppressed.

2. Exemplary Embodiment 2

Figure 5:
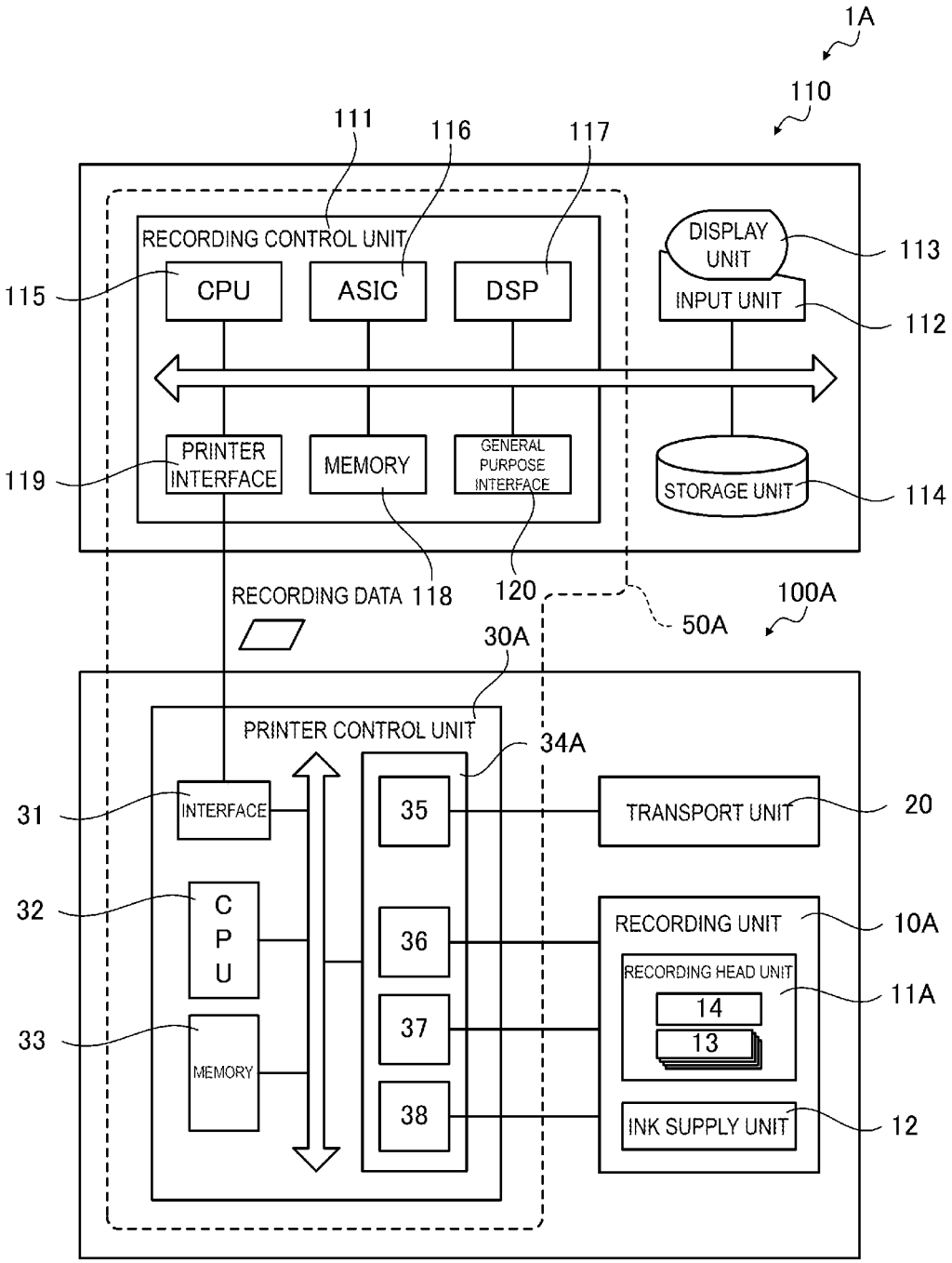
FIG. 5 is a block diagram illustrating a configuration of a recording system as a recording device according to Exemplary Embodiment 2.
Figure 6:
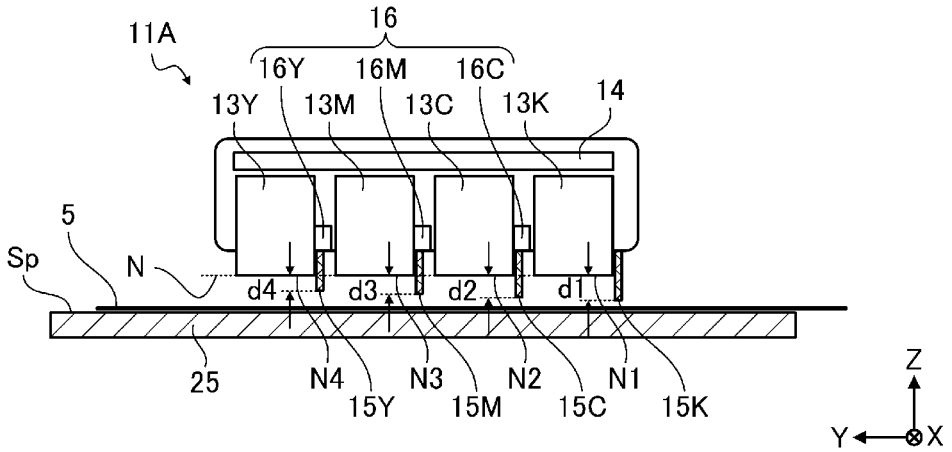
FIG. 6 is a schematic view illustrating a configuration example of a recording head unit according to Exemplary Embodiment 2, which is seen from a front surface.
Figure 7:
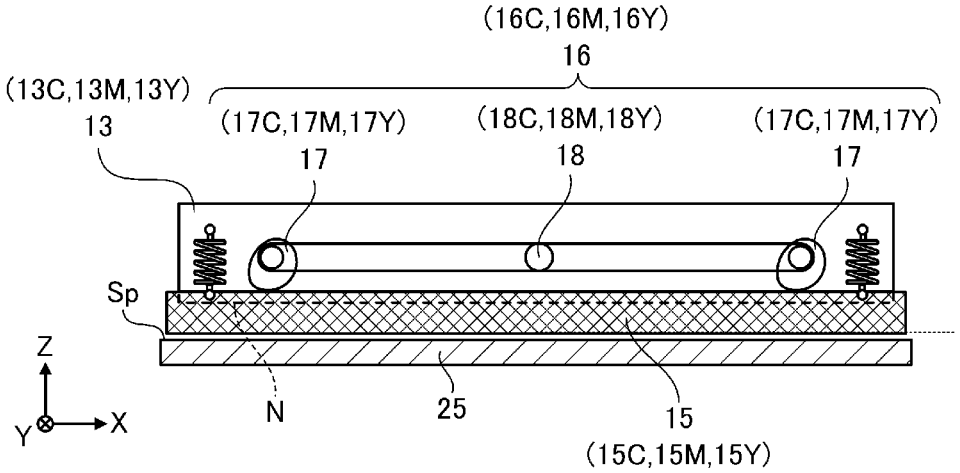
FIG. 7 is a schematic view illustrating a configuration of a cam mechanism.

With reference to FIG. 5 to FIG. 7, a configuration of a recording system 1A as a recording device according to Exemplary Embodiment 2 is described. Note that the same constituents as those in Exemplary Embodiment 1 are given the same reference signs, and redundant description of these constituents is omitted.

The recording system 1A according to the present exemplary embodiment includes a printer 100A in place of the printer 100.

The printer 100A includes a recording unit 10A in place of the recording unit 10, and a printer control unit 30A in place of the printer control unit 30.

The recording unit 10A includes a recording head unit 11A in place of the recording head unit 11.

The printer control unit 30A includes a drive control unit 34A in place of the drive control unit 34. The drive control unit 34A is obtained by further including a windbreak member drive circuit 38 in the drive control unit 34.

The recording control unit 111 and the printer control unit 30A constitutes a control unit 50A.

The recording head unit 11A is provided in such a way that a length by which each of the windbreak member 15C, the windbreak member 15M, and the windbreak member 15Y protrudes toward the direction to the platen 25 can be changed. Further, based on attribute information about the recording medium 5 and/or image data about an image recorded on the recording medium 5, the control unit 50A controls a length by which each of the windbreak member 15C, the windbreak member 15M, and the windbreak member 15Y protrudes.

Except for the matters described above, the recording system 1A is equivalent to the recording system 1. Details are described below.

As illustrated in FIG. 6, the recording head unit 11A includes a cam mechanism 16C, a cam mechanism 16M, and a cam mechanism 16Y serving as cam mechanisms 16 capable of changing protrusion amounts of the windbreak member 15C, the windbreak member 15M, and the windbreak member 15Y, respectively. As illustrated in FIG. 7, for example, the cam mechanism 16 includes eccentric plate cams 17 and a cam drive motor 18, and has a configuration in which a protrusion amount of a windbreak member 15 that abuts against the cam mechanism 16 can be changed by a rotation angle of the plate cams 17 rotated by the cam drive motor 18.

The cam mechanism 16C is a cam mechanism capable of changing the protrusion length of the windbreak member 15C toward the platen 25, and includes plate cams 17C and a cam drive motor 18C. The rotation angle of the cam drive motor 18C can change the protrusion length of the windbreak member 15C. The cam drive motor 18C is driven and controlled by the windbreak member drive circuit 38. Specifically, the windbreak member drive circuit 38 is capable of controlling the protrusion length of the windbreak member 15C.

Similarly, the cam mechanism 16M is a cam mechanism capable of changing the protrusion length of the windbreak member 15M toward the platen 25, and includes plate cams 17M and a cam drive motor 18M. The rotation angle of the cam drive motor 18M can change the protrusion length of the windbreak member 15M. The cam drive motor 18M is driven and controlled by the windbreak member drive circuit 38. Specifically, the windbreak member drive circuit 38 is capable of controlling the protrusion length of the windbreak member 15M.

Similarly, the cam mechanism 16Y is a cam mechanism capable of changing the protrusion length of the windbreak member 15Y toward the platen 25, and includes plate cams 17Y and a cam drive motor 18Y. The rotation angle of the cam drive motor 18Y can change the protrusion length of the windbreak member 15Y. The cam drive motor 18Y is driven and controlled by the windbreak member drive circuit 38. Specifically, the windbreak member drive circuit 38 is capable of controlling the protrusion length of the windbreak member 15Y.

The control unit 50A performs control, and thus the length from the support surface Sp of the platen 25, which supports the recording medium 5, to the protruding distal end of the windbreak member 15C is larger, than the length from the support surface Sp to the protruding distal end of the windbreak member 15K.

Further, the control unit 50A performs control, and thus the length from the support surface Sp to the protruding distal end of the windbreak member 15M is equal to or larger than the length from the support surface Sp to the protruding distal end of the windbreak member 15C.

Further, the control unit 50A performs control, and thus the length from the support surface Sp to the protruding distal end of the windbreak member 15Y is equal to or larger than the length from the support surface Sp to the protruding distal end of the windbreak member 15M.

Moreover, the control unit 50A is further capable of controlling the protrusion lengths of the windbreak member 15C, the windbreak member 15M, and the windbreak member 15Y, based on the attribute information about the recording medium 5.

Specifically, for example, a swelling degree due to the applied ink, that is, a cockling degree differs in some cases in accordance with specification of the recording medium 5. Thus, evaluation is performed on a cockling degree in advance for each specification of the recording medium 5. Then, the protrusion lengths of the windbreak member 15C, the windbreak member 15M, and the windbreak member 15Y are controlled in accordance with specification of the recording medium 5 while exerting a windbreak effect and preventing jamming from being caused.

The storage unit 114 stores an association table in advance, which indicates a relationship between the attribute information about the recording medium 5 associated with specification of the recording medium 5 and a necessary and sufficient protrusion length of the windbreak member 15 with respect to the recording medium 5 for each specification, and the control unit 50A refers to the association table, based on the attribute information about the recording medium 5. With this, control suitable for specification of the recording medium 5 can be performed.

Moreover, the control unit 50A is further capable of controlling the protrusion lengths of the windbreak member 15C, the windbreak member 15M, and the windbreak member 15Y, based on the image data about the image recorded on the recording medium 5.

Specifically, for example, a swelling degree of the recording medium 5, that is, a cockling degree differs in some cases in accordance with an amount of the ink applied on the recording medium 5. Thus, evaluation is performed on a cockling degree in advance for each amount of the ink applied on the recording medium 5. Then, the protrusion lengths of the windbreak member 15C, the windbreak member 15M, and the windbreak member 15Y are controlled in accordance with an amount of the ink applied on the recording medium 5 while exerting a windbreak effect and preventing jamming from being caused.

By referring to the image data, the control unit 50A is capable of grasping an increasing degree of the ink accumulatively applied on the recording medium 5 toward downstream on the platen 25. In accordance with the degree, a necessary and sufficient protrusion length of each of the windbreak members 15 is controlled.

Figure 8:
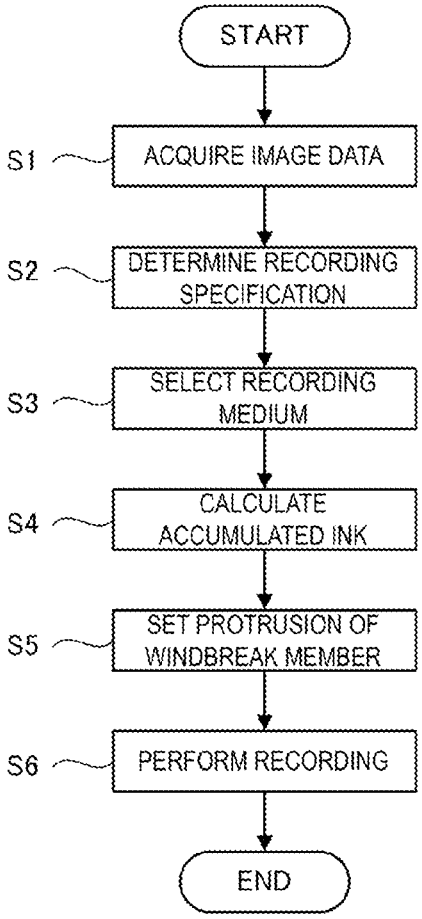
FIG. 8 is a flowchart of a recording method according to Exemplary Embodiment 2.

With reference to a flowchart illustrated in FIG. 8, a recording method according to the present exemplary embodiment is described.

The recording method according to the present exemplary embodiment includes an accumulated ink amount calculation step for calculating, based on the image data, a total amount of ink applied on the recording medium 5 at each of positions where the line heads 13 are arranged, and a control step for controlling, based on the accumulated ink amount calculated for each position at which the line head 13 is arranged, a length by which each of the windbreak member 15C, the windbreak member 15M, and the windbreak member 15Y protrudes.

A series of processing for performing recording is promoted with the functions of the image processing application and the printer driver. Specifically, the display unit 113 displays a required user interface screen for a user, and the user uses is allowed to use the input unit 112 to input a required instruction with respect to information displayed on the user interface screen. Specifically, the series of processing for performing recording is performed by the control unit 50A.

First, in Step S1, the image data to be recorded is acquired. Specifically, the image processing device 110 acquires the image data being a recording target from an external electronic device via the general purpose interface 120. Alternatively, the image data being a recording target is selected among the image data that is acquired in advance and is stored in the storage unit 114.

Subsequently, in Step S2, recording specification is determined. Specifically, with the functions of the image processing application and the printer driver, a size, recording specification including recording modes such as a resolution, sharpness, and the like of a recorded image is determined.

Subsequently, in Step S3, a type of the recording medium 5 on which recording is performed is selected.

Subsequently, in Step S4, the control unit 50A refers the image data, and calculates a total amount of ink applied on the recording medium 5 at each of positions where the line heads 13 are arranged. Step S4 corresponds to the accumulated ink amount calculation step.

Subsequently, in Step S5, the control unit 50A sets a length by which each of the windbreak member 15C, the windbreak member 15M, and the windbreak member 15Y protrudes.

Specifically, based on an amount of accumulated ink applied on the recording medium 5, which is calculated for each of the positions at which the line head 13C, the line head 13M, and the line head 13Y are arranged, a recording time determined with the recording specification, and the selected type of the recording medium 5, the control unit 50A derives a length by which each of the windbreak member 15C, the windbreak member 15M, and the windbreak member 15Y protrudes, from the association table or a calculation expression stored in advance in the storage unit 114. Based on the derived lengths, the control unit 50A controls the cam drive motor 18C via the windbreak member drive circuit 38, and causes the windbreak member 15C, the windbreak member 15M, and the windbreak member 15Y to protrude by predetermined lengths. Step S5 corresponds to the control step for controlling a length by which each of the windbreak member 15C, the windbreak member 15M, and the windbreak member 15Y protrudes.

Subsequently, in Step S6, the control unit 50A generates recording data based on the image data and the recording specification, and transmits the recording data to the printer 100 to perform recording.

According to the present exemplary embodiment, the following effects can be obtained.

While performing control in such a way that the length from the support surface Sp of the platen 25, which supports the recording medium 5, to the protruding distal end of the windbreak member 15C is larger than the length from the support surface Sp to the protruding distal end of the windbreak member 15K, that the length from the support surface Sp to the protruding distal end of the windbreak member 15M is equal to or larger than the length from the support surface Sp to the protruding distal end of the windbreak member 15C, or that the length from the support surface Sp to the protruding distal end of the windbreak member 15Y is equal to or larger than the length from the support surface Sp to the protruding distal end of the windbreak member 15M, the control unit 50A controls the protrusion lengths of the windbreak member 15C, the windbreak member 15M, and the windbreak member 15Y, based on the attribute information about the recording medium 5. As a result, while exerting a windbreak effect, suitable control can be performed with respect to specification of the recording medium 5 so as to prevent jamming from being caused.

Further, while performing control in such a way that the length from the support surface Sp of the platen 25, which supports the recording medium 5, to the protruding distal end of the windbreak member 15C is larger than the length from the support surface Sp to the protruding distal end of the windbreak member 15K, that the length from the support surface Sp to the protruding distal end of the windbreak member 15M is equal to or larger than the length from the support surface Sp to the protruding distal end of the windbreak member 15C, or that the length from the support surface Sp to the protruding distal end of the windbreak member 15Y is equal to or larger than the length from the support surface Sp to the protruding distal end of the windbreak member 15M, the control unit 50A controls the protrusion lengths of the windbreak member 15C, the windbreak member 15M, and the windbreak member 15Y, based on the image data about the image recorded on the recording medium 5. Specifically, by referring to the image data, the control unit 50A is capable of grasping an increasing degree of the ink accumulatively applied on the recording medium 5 toward downstream on the platen 25. In accordance with the degree, the protrusion lengths of the windbreak member 15C, the windbreak member 15M, and the windbreak member 15Y can be controlled. As a result, while exerting a windbreak effect, suitable control can be performed with respect to specification of the recording medium 5 so as to prevent jamming from being caused.

Further, according to the recording method according to the present exemplary embodiment, in the accumulated ink amount calculation step, an amount of accumulated ink applied on the recording medium 5 for each position at which the line head 13 is arranged can be grasped. In the control step, the lengths by which the windbreak member 15C, the windbreak member 15M, and the windbreak member 15Y protrude can be controlled in accordance with the amount of the accumulated ink. As a result, while exerting a windbreak effect, suitable control can be performed with respect to specification of the recording medium 5 so as to prevent jamming from being caused.

3. Exemplary Embodiment 3

The present exemplary embodiment is a modified example of Exemplary Embodiment 1.

In Exemplary Embodiment 1, it is described that the windbreak member 15 is a rectangular plate member extending in the X-Z plane, but the windbreak member 15 is not limited to a rectangular plate member.

Figure 9:
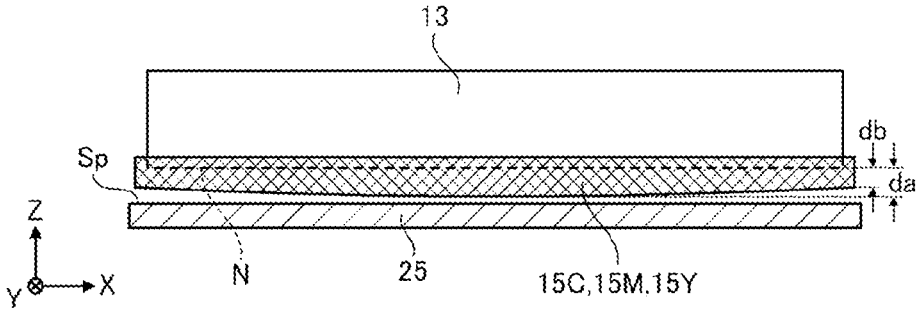
FIG. 9 is a schematic view illustrating a shape of a windbreak member according to Exemplary Embodiment 3.

As illustrated in FIG. 9, each of the windbreak member 15C, the windbreak member 15M, and the windbreak member 15Y in the present exemplary embodiment has such shape that protrusion lengths db in both end regions in the nozzle row direction, that is, the X-axis direction are smaller than a protrusion length da at the center in the nozzle row direction.

When the recording medium 5 is swollen on the platen 25 by the ink applied during recording, end regions of the recording medium 5 tend to rise upward from the platen 25 more than the center region thereof. According to the present exemplary embodiment, in each of the windbreak member 15C, the windbreak member 15M, and the windbreak member 15Y, the protrusion lengths in both the end regions in the nozzle row direction are smaller than the protrusion length at the center in the nozzle row direction. In other words, the lengths from the support surface Sp of the platen 25 to the windbreak member 15C, the windbreak member 15M, and the protruding distal end of the windbreak member 15Y are larger in both the end regions in the nozzle row direction than at the center in the nozzle row direction. Thus, the upwardly rising recording medium 5 due to swelling is prevented from being caught by the windbreak member 15C, the windbreak member 15M, and the windbreak member 15Y, and thus jamming can be suppressed.

4. Exemplary Embodiment 4

The present exemplary embodiment is a modified example of Exemplary Embodiment 1.

In Exemplary Embodiment 1, it is described that the windbreak member 15 is a rectangular plate member extending in the X-Z plane, but the windbreak member 15 is not limited to a rectangular plate member.

Figure 10:
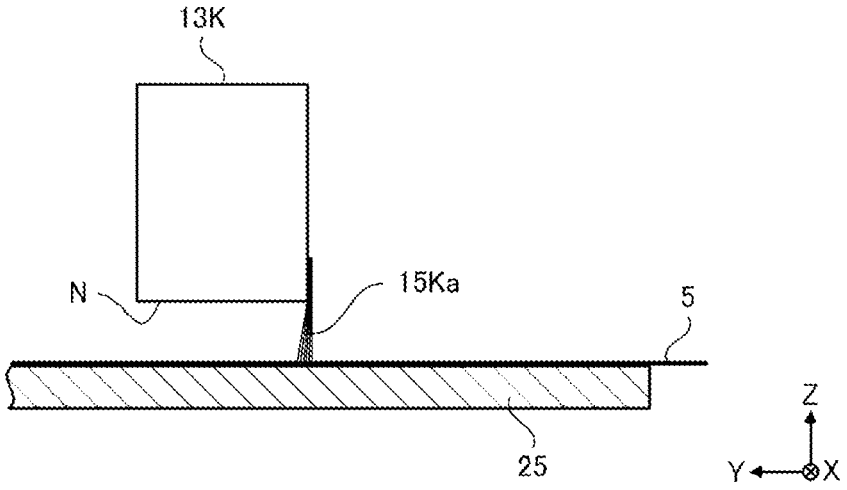
FIG. 10 is a schematic view illustrating a configuration of a first windbreak member according to Exemplary Embodiment 4.

As illustrated in FIG. 10, a windbreak member 15Ka in the present exemplary embodiment is constituted of an anti-static brush that abuts against the recording medium 5. The windbreak member 15Ka being an anti-static brush is a brush constituted of a bundle of conductive fibers, or fibers in which conductive fibers are woven, has a distal end held into contact with the surface of the recording medium 5 supported by the platen 25, and releases an electric charge generated when the surface of the recording medium 5 is charged, to a ground level to which the anti-static brush is conducted. The windbreak member 15Ka being an anti-static brush is provided along the width of the line head 13K in the nozzle row direction, that is, in the X-axis direction. Thus, an airflow generated during transporting the recording medium 5 can be prevented from flowing in between the nozzle opening surface N of the line head 13K and the recording medium 5.

As described above, the anti-static brush for preventing the surface of the recording medium 5 from being charged is used as the windbreak member 15Ka. With this, the windbreak member 15K is not required to be provided separately from an anti-static brush, which enables cost reduction.

5. Exemplary Embodiment 5

The present exemplary embodiment is a modified example of Exemplary Embodiment 1.

In Exemplary Embodiment 1, it is described that the windbreak member 15 is a rectangular plate member extending in the X-Z plane, but the windbreak member 15 is not limited to a rectangular plate member.

Figure 11:
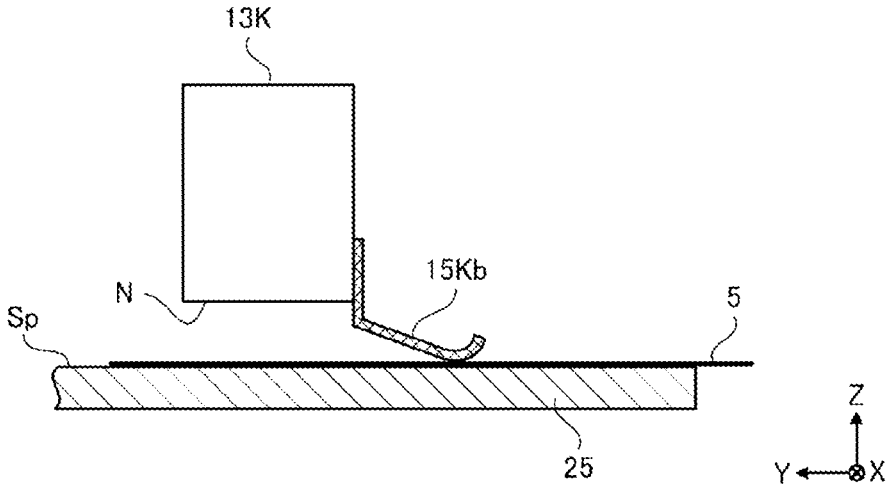
FIG. 11 is a schematic view illustrating a configuration of a first windbreak member according to Exemplary Embodiment 5.

A windbreak member 15Kb in the present exemplary embodiment is constituted of a guide member that guides the recording medium 5 to the platen 25. As illustrated in FIG. 11, the windbreak member 15Kb being a guide member is constituted of an elastic member that has a bent plate shape, has a side on the +Z side supported by the line head 13K and a side on the −Z side for guiding the recording medium 5 along the support surface Sp of the platen 25, and presses down the recording medium 5 in such a way that the recording medium 5 does not rise upward from the support surface Sp. The windbreak member 15Kb being a guide member is provided along the width of the line head 13K in the nozzle row direction, that is, in the X-axis direction. Thus, an airflow generated during transporting the recording medium 5 can be prevented from flowing in between the nozzle opening surface N of the line head 13K and the recording medium 5.

The guide member for guiding the recording medium 5 to the platen 25 is used as the windbreak member 15Kb. With this, the windbreak member 15K is not required to be provided separately from a guide member, which enables cost reduction.

What is claimed is:

1. A recording head unit, comprising:

a first line head and a second line head in which a plurality of nozzles for ejecting liquid are provided in a nozzle row direction, wherein the first line head is arranged on one side of the second line head in a head row direction intersecting the nozzle row direction, the first line head includes a first windbreak member, on the one side in the head row direction, along a width of the first line head in the nozzle row direction, the first windbreak member protruding, in a liquid ejection direction in which the liquid is ejected, with respect to a nozzle opening surface at which the plurality of nozzles included in the first line head are open, the second line head includes a second windbreak member between the second line head and the first line head along a width of the second line head in the nozzle row direction, the second windbreak member protruding, in the liquid ejection direction in which the liquid is ejected, with respect to a nozzle opening surface at which the plurality of nozzles included in the second line head are open, and a length by which the second windbreak member protrudes is smaller than a length by which the first windbreak member protrudes.

2. The recording head unit according to claim 1, comprising:

a third line head in which a plurality of nozzles for ejecting liquid are provided in a nozzle row direction, wherein the third line head is arranged on another side of the second line head in the head row direction, the third line head includes a third windbreak member between the third line head and the second line head along a width of the third line head in the nozzle row direction, the third windbreak member protruding, in the liquid ejection direction in which the liquid is ejected, with respect to a nozzle opening surface at which the plurality of nozzles included in the third line head are open, and a length by which the third windbreak member protrudes is equal to or smaller than the length by which the second windbreak member protrudes.

3. A recording device, comprising:

a platen configured to support a recording medium;

a first line head and a second line head facing the platen and in which a plurality of nozzles for ejecting liquid onto the recording medium supported by the platen are provided in a nozzle row direction; and a transport unit configured to transport the recording medium supported by the platen in a transport direction intersecting the nozzle row direction, wherein the first line head is arranged upstream of the second line head in the transport direction, the first line head includes a first windbreak member upstream thereof in the transport direction along a width of the first line head in the nozzle row direction, the first windbreak member protruding, toward the platen, with respect to a nozzle opening surface at which the plurality of nozzles included in the first line head are open, the second line head includes a second windbreak member between the second line head and the first line head along a width of the second line head in the nozzle row direction, the second windbreak member protruding, toward the platen, with respect to a nozzle opening surface at which the plurality of nozzles included in the second line head are open, and a length by which the second windbreak member protrudes is smaller than a length by which the first windbreak member protrudes.

4. The recording device according to claim 3, wherein the second windbreak member is provided so that the length by which the second windbreak member protrudes toward the platen is changeable, and the recording device comprises a control unit configured to control the length by which the second windbreak member protrudes, based on attribute information of the recording medium and/or image data of an image to be recorded on the recording medium.

5. The recording device according to claim 3, wherein the length by which the second windbreak member protrudes in both end regions in the nozzle row direction is smaller than the length by which the second windbreak member protrudes at a center in the nozzle row direction.

6. The recording device according to claim 3, comprising:

a third line head in which a plurality of nozzles for ejecting liquid are provided in a nozzle row direction, wherein the third line head is arranged downstream of the second line head in the transport direction, the third line head includes a third windbreak member between the third line head and the second line head along a width of the third line head in the nozzle row direction, the third windbreak member protruding toward the platen with respect to a nozzle opening surface at which the plurality of nozzles included in the third line head are open, and a length by which the third windbreak member protrudes is equal to or smaller than the length by which the second windbreak member protrudes.

7. The recording device according to claim 6, wherein the second windbreak member and the third windbreak member are provided so that the lengths by which the second windbreak member and the third windbreak member protrude toward the platen are changeable, and the recording device comprises a control unit configured to control the lengths by which the second windbreak member and the third windbreak member protrude based on attribute information of the recording medium and/or image data of an image to be recorded on the recording medium.

8. A recording method using the recording device according to claim 7, the recording method comprising:

an accumulated liquid amount calculating step of calculating, based on the image data, an amount of accumulated liquid applied on the recording medium at each of positions where the line heads are arranged; and a controlling step of controlling the lengths by which the second windbreak member and the third windbreak member protrude, based on the amount of the accumulated liquid calculated for each of the positions where the line heads are arranged.

9. The recording device according to claim 6, wherein the lengths by which the second windbreak member and the third windbreak member protrude in both end regions in the nozzle row direction are smaller than the lengths by which the second windbreak member and the third windbreak member protrude at a center in the nozzle row direction.

10. The recording device according to claim 3, wherein the first windbreak member includes an anti-static brush that abuts against the recording medium.

11. The recording device according to claim 3, wherein the first windbreak member includes a guide member configured to guide the recording medium to the platen.

* * * * *